US009379451B2

(12) United States Patent
Hsu et al.

(10) Patent No.: US 9,379,451 B2
(45) Date of Patent: Jun. 28, 2016

(54) BROADBAND DUAL POLARIZATION ANTENNA

(71) Applicant: Wistron NeWeb Corporation, Hsinchu (TW)

(72) Inventors: Chieh-Sheng Hsu, Hsinchu (TW); Chang-Hsiu Huang, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 297 days.

(21) Appl. No.: 13/851,945

(22) Filed: Mar. 27, 2013

(65) Prior Publication Data

US 2014/0191919 A1 Jul. 10, 2014

(30) Foreign Application Priority Data

Jan. 7, 2013 (TW) ..... 102100436

(51) Int. Cl.

| | |
|---|---|
| ***H01Q 19/10*** | (2006.01) |
| ***H01Q 19/18*** | (2006.01) |
| ***H01Q 9/04*** | (2006.01) |
| ***H01Q 9/16*** | (2006.01) |
| ***H01Q 21/24*** | (2006.01) |

(52) U.S. Cl.

CPC ..... *H01Q 19/10* (2013.01); *H01Q 9/0414* (2013.01); *H01Q 9/16* (2013.01); *H01Q 21/24* (2013.01)

(58) Field of Classification Search

CPC ..... H01Q 19/10; H01Q 9/0414; H01Q 9/16; H01Q 21/24

See application file for complete search history.

(56) References Cited

U.S. PATENT DOCUMENTS

| | | | | |
|---|---|---|---|---|
| 8,564,484 | B2 | 10/2013 | Jan | |
| 2005/0110687 | A1* | 5/2005 | Starkie | H01Q 5/00 343/700 MS |
| 2007/0279291 | A1* | 12/2007 | Tsai et al. | 343/700 MS |
| 2008/0252530 | A1 | 10/2008 | Bae | |
| 2009/0073075 | A1* | 3/2009 | Irion et al. | 343/859 |
| 2010/0289714 | A1 | 11/2010 | Peng | |
| 2011/0316755 | A1* | 12/2011 | Ayatollahi et al. | 343/793 |
| 2012/0068892 | A1 | 3/2012 | Shtrom | |
| 2012/0133567 | A1* | 5/2012 | Harel | H01Q 1/38 343/798 |

FOREIGN PATENT DOCUMENTS

| | | |
|---|---|---|
| CN | 101714702 | 5/2010 |
| TW | I237924 | 8/2005 |
| TW | 201108510 | 3/2011 |
| TW | 201236267 | 9/2012 |
| WO | 2012162975 A1 | 12/2012 |

OTHER PUBLICATIONS

Chieh-Sheng Hsu, Title: Broadband Antenna, pending U.S. Appl. No. 14/481,907, filing date: Sep. 9, 2014.

* cited by examiner

*Primary Examiner* — Hoang V Nguyen
*Assistant Examiner* — Michael Bouizza
(74) *Attorney, Agent, or Firm* — Winston Hsu; Scott Margo

(57) ABSTRACT

A broadband dual polarization antenna comprises a first metal reflective plane, for reflecting radio signals, to enhance the gain of the broadband dual polarization antenna; a first radiation portion, disposed on the first metal reflective plane with a first gap to the first metal reflective plane; a second radiation portion, disposed on the first radiation portion with a second gap to the first radiation portion; and a supporting element, for supporting and isolating the first metal reflective plane, the first radiation portion and the second radiation portion.

14 Claims, 15 Drawing Sheets

BROADBAND DUAL POLARIZATION ANTENNA

BACKGROUND OF THE INVENTION

1. Field of the Invention

The present invention relates to a broadband dual polarization antenna, and more particularly, to a broadband dual polarization antenna capable of improving antenna field pattern, isolation and operating bandwidth.

2. Description of the Prior Art

Electronic products with wireless communication functionalities, e.g. notebook computers, personal digital assistants, etc., utilize antennas to emit and receive radio waves, to transmit or exchange radio signals, so as to access a wireless communication network. Therefore, to facilitate a user's access to the wireless communication network, an ideal antenna should maximize its bandwidth within a permitted range, while minimizing physical dimensions to accommodate the trend for smaller-sized electronic products. Additionally, with the advance of wireless communication technology, electronic products may be configured with an increasing number of antennas. For example, a long term evolution (LTE) wireless communication system supports multi-input multi-output (MIMO) technology, i.e. an electronic product is capable of concurrently receiving and transmitting wireless signals via multiple (or multiple sets of) antennas, to vastly increase system throughput and transmission distance without increasing system bandwidth or total transmission power expenditure, thereby effectively enhancing spectral efficiency and transmission rate for the wireless communication system, as well as improving communication quality. Moreover, operating frequency bands of the LTE wireless system are wider, which increases complexity of antenna design.

In detail, the LTE wireless communication system includes 44 bands which cover from 698 MHz to 3800 MHz. Due to the bands are separated and disordered, a mobile system operator may use multiple bands simultaneously in the same country or area. Under such a situation, conventional dual polarization antennas may not be able to cover all the bands, such that transceivers of the LTE wireless communication system can not receive and transmit wireless signals of multiple bands.

As can be seen, in the LTE wireless communication system, bandwidth of a dual polarization antenna must be as wide as possible, such that the transceivers can receive and transmit wireless signals of multiple bands. Therefore, an improvement over the prior art is necessary.

SUMMARY OF THE INVENTION

Therefore, the present invention provides a broadband dual polarization antenna with metal reflective planes, capable of being bending, to improve antenna field pattern, isolation and operating bandwidth.

The present invention discloses a broadband dual polarization antenna for receiving and transmitting radio signals, which comprises a first metal reflective plane, for reflecting radio signals, to enhance the gain of the broadband dual polarization antenna; a first radiation portion, disposed on the first metal reflective plane with a first gap to the first metal reflective plane; a second radiation portion, disposed on the first radiation portion with a second gap to the first radiation portion; and a supporting element, for supporting and isolating the first metal reflective plane, the first radiation portion and the second radiation portion.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
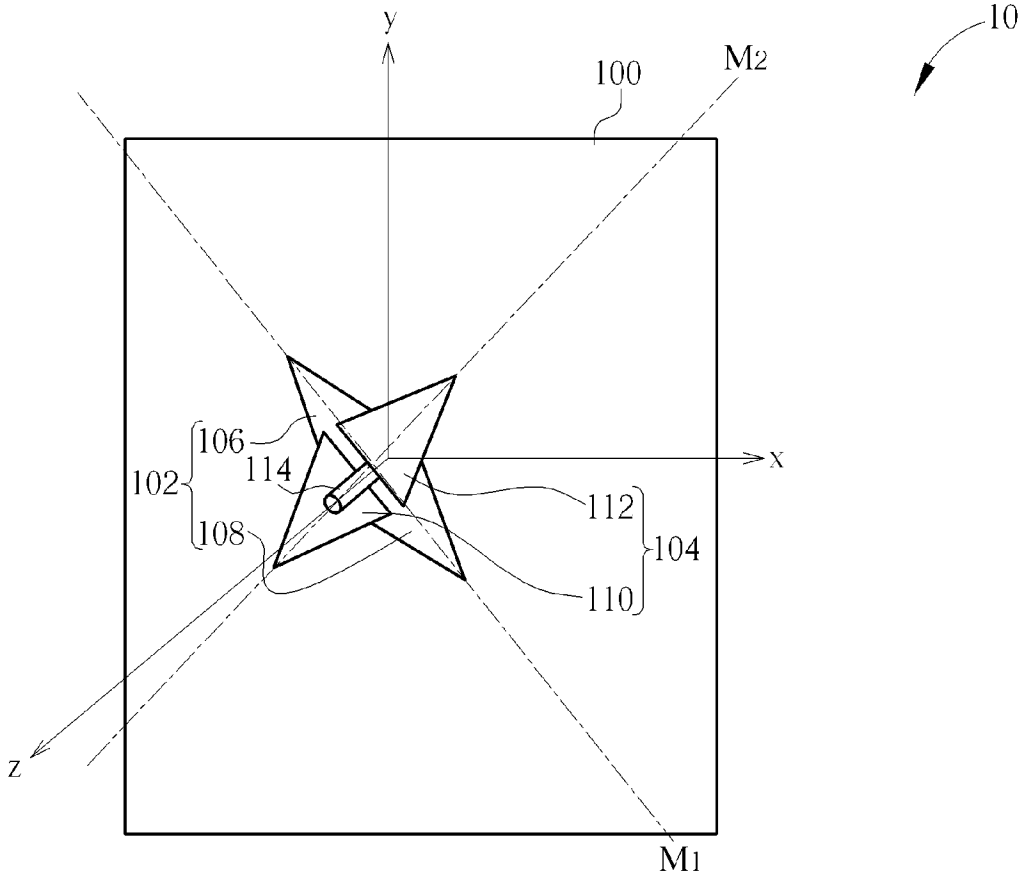
FIG. 1A is a schematic diagram of a broadband dual polarization antenna according an embodiment of the present invention.
Figure 1B:
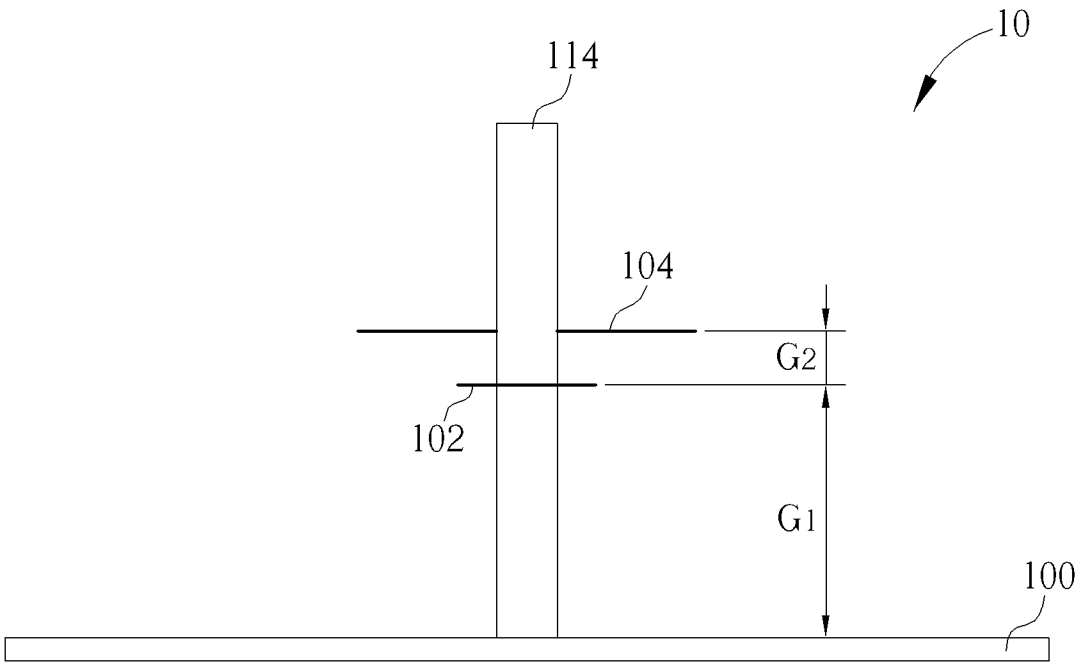
FIG. 1B is a side-view diagram of the broadband dual polarization antenna shown in FIG. 1A.

Please refer to FIGS. 1A and 1B. FIG. 1A is a schematic diagram of a broadband dual polarization antenna 10 according an embodiment of the present invention. FIG. 1B is a side-view diagram of the broadband dual polarization antenna 10. The broadband dual polarization antenna 10 comprises a first metal reflective plane 100, a first radiation portion 102, a second radiation portion 104, and a supporting element 114. The first metal reflective plane 100 substantially conforms to a square, but is not limited thereto. The first metal reflective plane 100 may conform to other symmetric shapes such as a circle, a right octahedron, or a right polyhedron, etc., and is utilized for reflecting radio signals, to enhance gains of the broadband dual polarization antenna 10. The first radiation portion 102 is disposed on the first metal reflective plane 100 with a first gap G1 to the first metal reflective plane and comprises a first triangular metal plate 106 and a second triangular metal plate 108. A base of the first triangular metal plate 106 is parallel to a base of the second triangular metal plate 108, such that the first radiation portion 102 conforms to a rhombus. The second radiation portion 104 is disposed on the first radiation portion 102 with a second gap G2 to the first radiation portion 102 and comprises a third triangular metal plate 110 and a fourth triangular metal plate 112. A base of the third triangular metal plate 110 is parallel to a base of the fourth triangular metal plate 112, such that the second radiation portion 104 conforms to the rhombus. In the embodiment of the present invention, the first, second, third, and fourth triangular metal plates 106, 108, 110, and 112 conform to isosceles triangles, but are not limited thereto. An angle between a first midline M1 of the first radiation portion 102 and a second midline M2 of the second radiation portion 104 is substantially equal to 90 degrees. The supporting element 114 is substantially perpendicular to the first metal reflective plane 100 and is utilized for supporting the first metal reflective plane 100, the first radiation portion 102, and the second radiation portion 104, such that the first metal reflective plane 100, the first radiation portion 102, and the second radiation portion 104 are not electrically connected to each other.

In short, the embodiment of the present invention receives and transmits wireless signals through the first radiation portion 102 and the second radiation portion 104, which are 45-degree slant polarized. Therefore, projections of the first midline M1 and the second midline M2 on the first metal reflective plane 100 substantially match with diagonal lines of the first metal reflective plane 100 (i.e. the first radiation portion 102 is 45-degree slant polarized and the second radiation portion 104 is 135-degree slant polarized).

Note that, the broadband dual polarization antenna 10 is an embodiment of the present invention. Those skilled in the art should make modifications or alterations accordingly. For example, edge lengths of the first metal reflective plane 100 can be modified according to system requirements, and are not fixed. On the other hand, the first gap G1 is related to the operating frequency of the broadband dual polarization antenna 10. In general, when the first gap G1 is substantially equal to a quarter of a wavelength of wireless signals, the broadband dual polarization antenna 10 can reach a maximum gain. Therefore, if the broadband dual polarization antenna 10 is utilized for receiving or transmitting wireless signals of Band38/40/42 in the LTE wireless communication system, the first gap G1 is substantially equal to 20 mm but is not limited thereto. Those skilled in the art should adjust the first gap G1 according to different operating frequency bands of antennas. Besides, the second gap G2 is utilized for enhance isolation between the first radiation portion 102 and the second radiation portion 104, to avoid antennas of 45-degree slant polarized and 135-degree slant polarized interfering to each other. For example, the second gap G2 can be substantially equal to 5 mm, but is not limited thereto. Certainly, for obtaining higher isolation, the second gap G2 (i.e. a distance between the first radiation portion 102 and the second radiation portion 104) can be increased appropriately. However, increasing the second gap G2 may cause variations of other characteristics (such as gains and field patterns) of the broadband dual polarization antenna 10. Those skilled in the art should adjust the second gap G2 according to different applications. Finally, the supporting element 114 is made of an isolation material (such as wood, glass, rubber), but is not limited thereto. The supporting element 114 can be made by other materials, as long as the first metal reflective plane 100, the first radiation portion 102, and the second radiation portion 104 are not electrically connected to each other.

Figure 2:
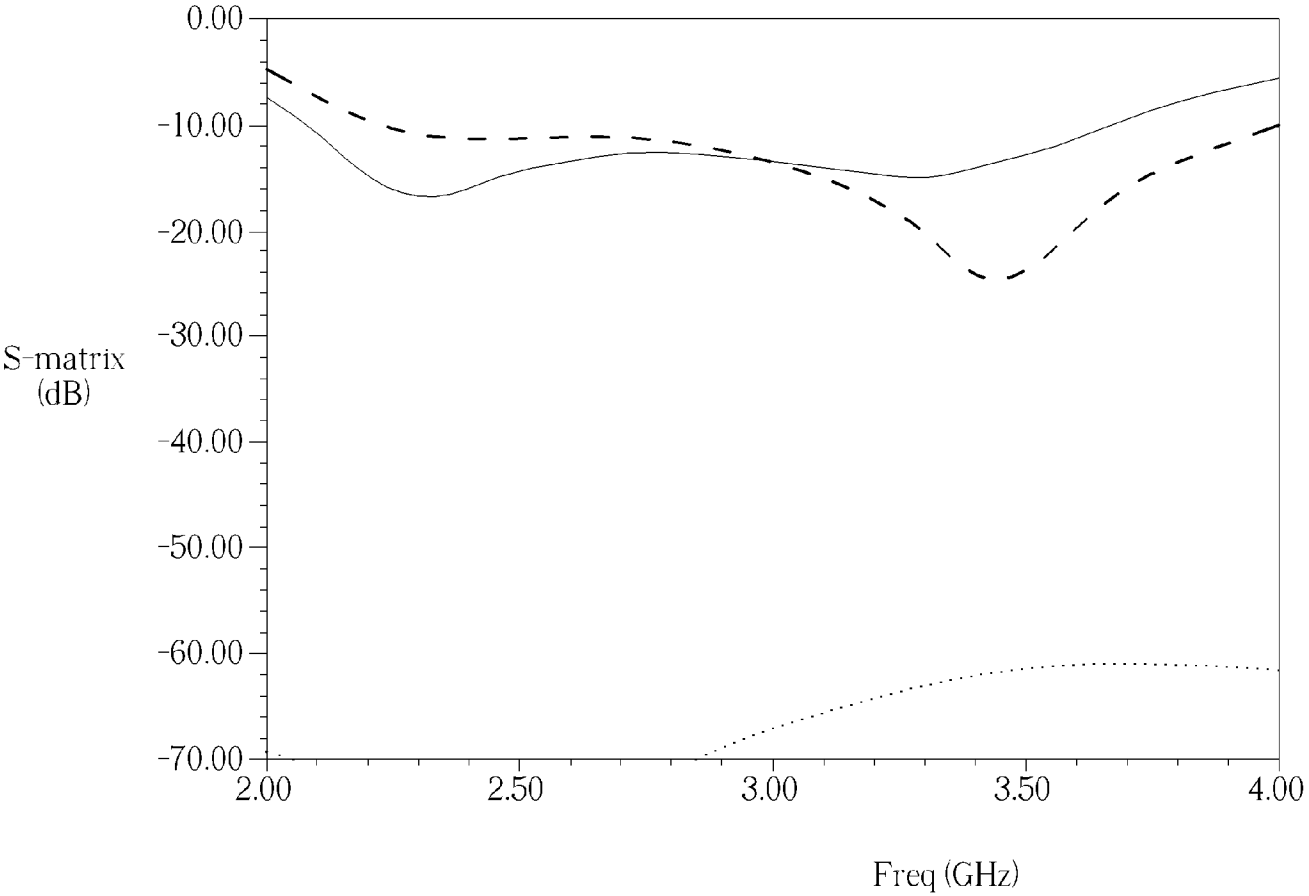
FIG. 2 is simulation results of antenna resonance and isolation of the broadband dual polarization antenna shown in FIG. 1A.

For explaining efficiency of the present invention, furthermore, characteristics of the broadband dual polarization antenna 10 can be obtained by simulation. Please refer to FIG. 2. FIG. 2 illustrates simulation results of antenna resonance and isolation of the broadband dual polarization antenna 10. Simulation conditions of FIG. 2 are shown as follows: the first gap G1 is equal to 20 mm, the second gap G2 is equal to 5 mm, and each edge of the first metal reflective plane 100 is 160 mm long. Besides, a dashed line and a solid line on the top of FIG. 2 are resonance curves of the first radiation portion 102 and the second radiation portion 104 respectively, and a dotted line on the bottom of FIG. 2 is a curve of isolation between the first radiation portion 102 and the second radiation portion 104. As can be seen in FIG. 2, by taking −10 dB as a reference, resonance bandwidth of the broadband dual polarization antenna 10 includes LTE Band38/40/42 simultaneously, and isolation thereof reaches at least −61 dB. On the other hand, please refer to Tables 1, 2, 3, and 4. The Tables 1 and 2 are simulation results of field patterns for the first radiation portion 102 on the vertical and horizontal planes respectively, and the Tables 3 and 4 are simulation results of field patterns for the second radiation portion 104 on the vertical and horizontal planes respectively. As can be seen in the Tables 1 and 2, maximum gains of the first radiation portion 102 are between 8.50 dBi and 9.40 dBi, and vary slightly between high frequency and low frequency. Contrarily, as can be seen in the Tables 3 and 4, maximum gains of the second radiation portion 104 are 9.38 dBi in low frequency (2300 MHz) and 7.82 dBi in high frequency (3600 MHz). The results above is related the first gap G1 which is designed for Band38/40/42 in the LTE wireless communication system, such that reflective wireless signals and original wireless signals can have the same phase, to increase the gains of the broadband dual polarization antenna 10. In the broadband dual polarization antenna 10, in order to maintain wide-band resonance characteristic for the broadband dual polarization antenna 10, interference between the first radiation portion 102 and the second radiation portion 104 must be minimized. Therefore, a distance between the first radiation portion 102 and the second radiation portion 104 is increased, such that a distance between the first metal reflective plane 100 and the second radiation portion 104 is increased by about 5 mm as well, and a path of wireless signals becomes longer. Effects of increasing the distance between the first metal reflective plane 100 and the second radiation portion 104 in the high frequency is more obvious than effects in the low frequency. As a result, the gains of the first radiation portion 102 are greater than the gains of the second radiation portion 104, and the isolation of the broadband dual polarization antenna 10 is good.

TABLE 1

| frequency | peak gain | 3 dB beamwidth | front-to-back ratio | Co/Cx |
|---|---|---|---|---|
| 2300 (MHz) | 9.31 dBi | 62 deg | 19.7 dB | 21.5 dB |
| 2400 (MHz) | 9.40 dBi | 63 deg | 19.9 dB | 21.6 dB |
| 2570 (MHz) | 9.34 dBi | 64 deg | 20.4 dB | 22.2 dB |
| 2620 (MHz) | 9.30 dBi | 65 deg | 20.5 dB | 22.4 dB |
| 3400 (MHz) | 8.70 dBi | 77 deg | 22.6 dB | 21.3 dB |
| 3600 (MHz) | 8.50 dBi | 79 deg | 23.3 dB | 22.3 dB |

TABLE 2

| frequency | peak gain | 3 dB beamwidth | front-to-back ratio | Co/Cx |
|---|---|---|---|---|
| 2300 (MHz) | 9.31 dBi | 62 deg | 19.7 dB | 21.4 dB |
| 2400 (MHz) | 9.40 dBi | 63 deg | 19.9 dB | 21.5 dB |
| 2570 (MHz) | 9.34 dBi | 64 deg | 20.4 dB | 22.1 dB |
| 2620 (MHz) | 9.30 dBi | 65 deg | 20.5 dB | 22.4 dB |
| 3400 (MHz) | 8.70 dBi | 77 deg | 22.6 dB | 21.2 dB |
| 3600 (MHz) | 8.50 dBi | 79 deg | 23.3 dB | 22.0 dB |

TABLE 3

| frequency | peak gain | 3 dB beamwidth | front-to-back ratio | Co/Cx |
|---|---|---|---|---|
| 2300 (MHz) | 9.38 dBi | 64 deg | 18.7 dB | 21.0 dB |
| 2400 (MHz) | 9.39 dBi | 64 deg | 18.9 dB | 21.1 dB |
| 2570 (MHz) | 9.24 dBi | 66 deg | 19.2 dB | 21.6 dB |
| 2620 (MHz) | 9.17 dBi | 67 deg | 19.3 dB | 21.8 dB |
| 3400 (MHz) | 8.22 dBi | 81 deg | 21.0 dB | 20.9 dB |
| 3600 (MHz) | 7.82 dBi | 83 deg | 21.8 dB | 22.0 dB |

TABLE 4

| frequency | peak gain | 3 dB beamwidth | front-to-back ratio | Co/Cx |
|---|---|---|---|---|
| 2300 (MHz) | 9.38 dBi | 64 deg | 18.7 dB | 21.1 dB |
| 2400 (MHz) | 9.39 dBi | 64 deg | 18.9 dB | 21.2 dB |
| 2570 (MHz) | 9.24 dBi | 66 deg | 19.2 dB | 21.7 dB |
| 2620 (MHz) | 9.17 dBi | 67 deg | 19.3 dB | 21.9 dB |
| 3400 (MHz) | 8.22 dBi | 81 deg | 21.0 dB | 21.0 dB |
| 3600 (MHz) | 7.82 dBi | 83 deg | 21.8 dB | 22.0 dB |

As shown in FIG. 1 and FIG. 2, the first metal reflective plane 100 is parallel to the second radiation portion 104 (i.e. the first triangular metal plate 106 and the second triangular metal plate 108 of the first metal reflective plane 100 are disposed in a first plane, and the third triangular metal plate 110 and the fourth triangular metal plate 112 of the second radiation portion 104 are disposed in a second plane, wherein the first plane is parallel to the second plane). However, such a structure is an embodiment of the present invention, and is not limited thereto.

Figure 3A:
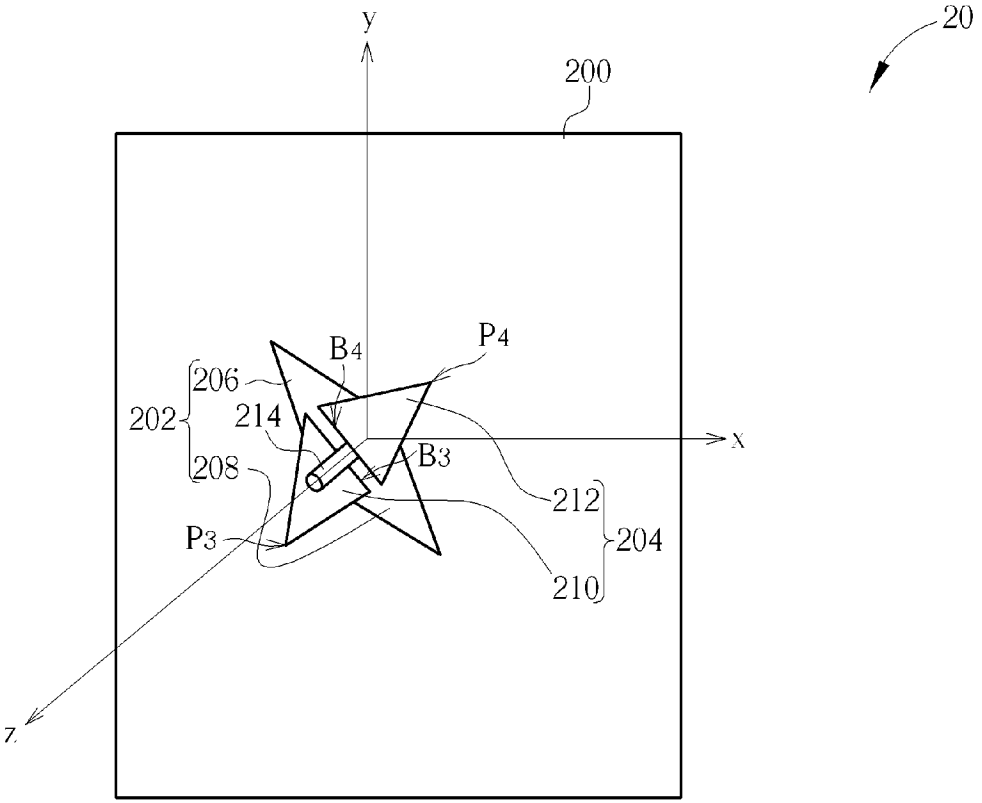
FIG. 3A is a schematic diagram of a broadband dual polarization antenna according an embodiment of the present invention.
Figure 3B:
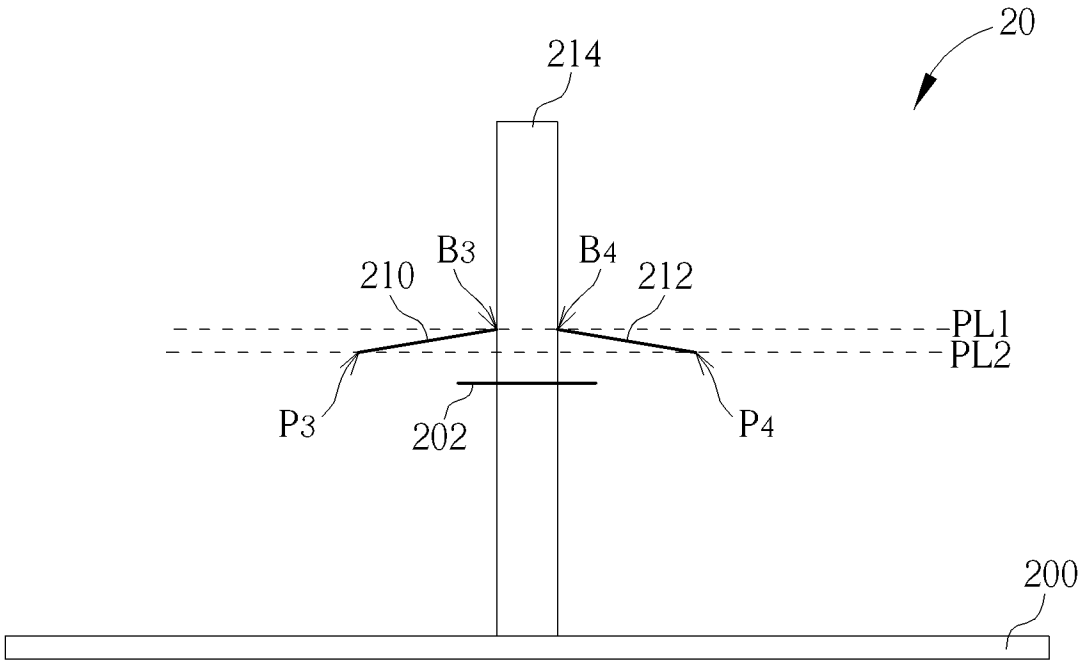
FIG. 3B is a side-view diagram of the broadband dual polarization antenna shown in FIG. 3A.

For example, please refer to FIGS. 3A and 3B. FIG. 3A is a schematic diagram of a broadband dual polarization antenna 20 according an embodiment of the present invention. FIG. 3B is a side-view diagram of the broadband dual polarization antenna 20. The broadband dual polarization antenna 20 comprises a first metal reflective plane 200, a first radiation portion 202, a second radiation portion 204, and a supporting element 214. The first radiation portion 202 comprises a first triangular metal plate 206 and a second triangular metal plate 208, and the second radiation portion 204 comprises a third triangular metal plate 210 and a fourth triangular metal plate 212. In this embodiment, the first, second, third, and fourth triangular metal plates 206, 208, 210, and 212 conform to isosceles triangles, but are not limited thereto. As can be seen by comparing FIG. 1A/1B with FIG. 3A/3B, structures and operations of the broadband dual polarization antenna 10 and the broadband dual polarization antenna 20 are similar. The difference between the broadband dual polarization antenna 10 and the broadband dual polarization antenna 20 is that the second radiation portion 204 is leaned down from the supporting element 214 to outside. In other words, the first radiation portion 202 is not parallel to the second radiation portion 204, and the third triangular metal plate 210 and the fourth triangular metal plate 212 do not extend in the same plane. In detail, as shown in FIG. 3B, a base B3 of the third triangular metal plate 210 and a base B4 of the fourth triangular metal plate 212 can be seen as disposed in a first plane PL1 or extending on the first plane PL1, and a vertex P3 of an opposite angle corresponding to the base B3 and a vertex P4 of an opposite angle corresponding to the base B4 are disposed in a second plane PL2, wherein the first plane PL1 and the second plane PL2 are not the same plane, and are separated by a distance, such as 1 mm. Besides, a distance between the first metal reflective plane 200 and the second radiation portion 204 can be adjusted according to different applications, such as about 24.7 mm.

Figure 4:
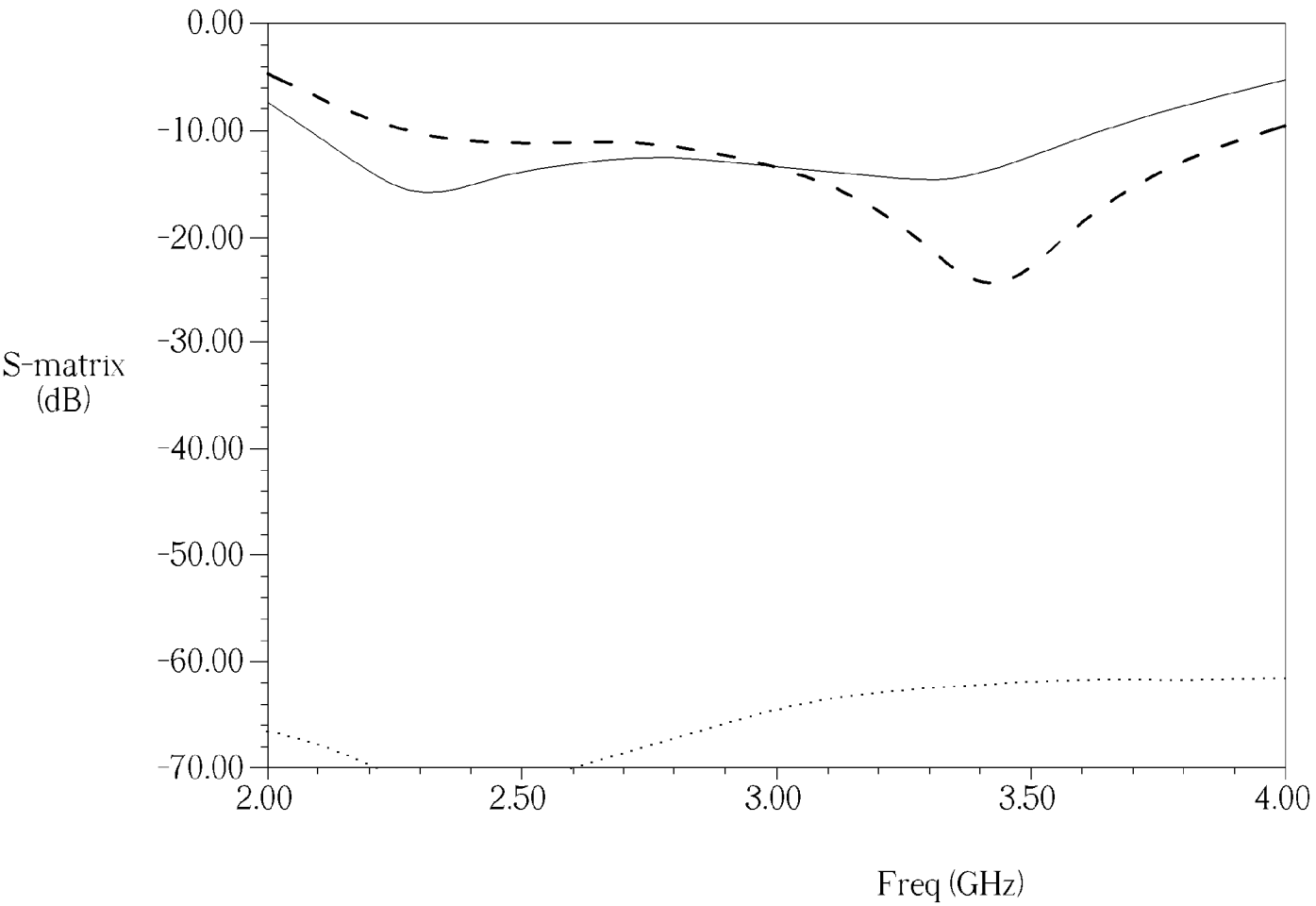
FIG. 4 is simulation results of antenna resonance and isolation of the broadband dual polarization antenna shown in FIG. 3A.

Furthermore, characteristics of the broadband dual polarization antenna 20 can be obtained by simulation. Please refer to FIG. 4. FIG. 4 illustrates simulation results of antenna resonance and isolation of the broadband dual polarization antenna 20. Simulation conditions of FIG. 4 are shown as follows: the distance between the first plane PL1 and the second plane PL2 is equal to 1 mm, the distance between the first metal reflective plane 200 and the second radiation portion 204 is equal to 24.7 mm. Besides, a dashed line and a solid line on the top of FIG. 4 are resonance curves of the first radiation portion 202 and the second radiation portion 204 respectively, and a dotted line on the bottom of FIG. 4 is a curve of isolation between the first radiation portion 202 and the second radiation portion 204. As can be seen in FIG. 4, by taking −10 dB as a reference, resonance bandwidth of the broadband dual polarization antenna 20 includes LTE Band38/40/42 simultaneously, and isolation thereof reaches at least −61.7 dB. On the other hand, please refer to Tables 5, 6, 7, and 8. The Tables 5 and 6 are simulation results of field patterns for the first radiation portion 202 on the vertical and horizontal planes respectively, and the Tables 7 and 8 are simulation results of field patterns for the second radiation portion 204 on the vertical and horizontal planes respectively. As can be seen in the Tables 3 and 4, maximum gains of the first radiation portion 202 are between 8.55 dBi and 9.41 dBi, and vary slightly between high frequency and low frequency. Contrarily, as can be seen in the Tables 7 and 8, maximum gains of the second radiation portion 204 are 9.36 dBi in low frequency (2300 MHz) and 7.96 dBi in high frequency (3600 MHz).

As can be seen by comparing simulation results of the broadband dual polarization antenna 10 and the broadband dual polarization antenna 20, the maximum gain of the second radiation portion 204 is 0.14 dB larger than the maximum gain of the second radiation portion 104, and the rest of maximum gains vary slightly. Therefore, bending the second radiation portion 204 forward to the first radiation portion 202 actually increases field patterns, to adapt to different applications.

TABLE 5

| frequency | peak gain | 3 dB beamwidth | front-to-back ratio | Co/Cx |
|---|---|---|---|---|
| 2300 (MHz) | 9.31 dBi | 62 deg | 19.5 dB | 21.5 dB |
| 2400 (MHz) | 9.41 dBi | 62 deg | 19.8 dB | 21.6 dB |
| 2570 (MHz) | 9.37 dBi | 64 deg | 20.3 dB | 22.1 dB |
| 2620 (MHz) | 9.33 dBi | 64 deg | 20.4 dB | 22.4 dB |
| 3400 (MHz) | 8.75 dBi | 77 deg | 22.4 dB | 21.2 dB |
| 3600 (MHz) | 8.55 dBi | 79 deg | 23.0 dB | 22.1 dB |

TABLE 6

| frequency | peak gain | 3 dB beamwidth | front-to-back ratio | Co/Cx |
|---|---|---|---|---|
| 2300 (MHz) | 9.31 dBi | 62 deg | 19.5 dB | 21.5 dB |
| 2400 (MHz) | 9.41 dBi | 62 deg | 19.8 dB | 21.7 dB |
| 2570 (MHz) | 9.37 dBi | 63 deg | 20.3 dB | 22.2 dB |
| 2620 (MHz) | 9.33 dBi | 64 deg | 20.4 dB | 22.5 dB |
| 3400 (MHz) | 8.75 dBi | 76 deg | 22.4 dB | 21.7 dB |
| 3600 (MHz) | 8.55 dBi | 79 deg | 23.0 dB | 22.8 dB |

TABLE 7

| frequency | peak gain | 3 dB beamwidth | front-to-back ratio | Co/Cx |
|---|---|---|---|---|
| 2300 (MHz) | 9.36 dBi | 64 deg | 19.0 dB | 21.4 dB |
| 2400 (MHz) | 9.37 dBi | 64 deg | 19.2 dB | 21.6 dB |
| 2570 (MHz) | 9.22 dBi | 66 deg | 19.5 dB | 22.3 dB |
| 2620 (MHz) | 9.16 dBi | 67 deg | 19.7 dB | 22.5 dB |
| 3400 (MHz) | 8.34 dBi | 79 deg | 21.2 dB | 21.4 dB |
| 3600 (MHz) | 7.96 dBi | 81 deg | 21.7 dB | 22.3 dB |

TABLE 8

| frequency | peak gain | 3 dB beamwidth | front-to-back ratio | Co/Cx |
|---|---|---|---|---|
| 2300 (MHz) | 9.36 dBi | 64 deg | 19.0 dB | 21.3 dB |
| 2400 (MHz) | 9.37 dBi | 64 deg | 19.2 dB | 21.5 dB |
| 2570 (MHz) | 9.22 dBi | 66 deg | 19.5 dB | 22.3 dB |
| 2620 (MHz) | 9.16 dBi | 67 deg | 19.7 dB | 22.6 dB |
| 3400 (MHz) | 8.34 dBi | 79 deg | 21.2 dB | 21.8 dB |
| 3600 (MHz) | 7.96 dBi | 81 deg | 21.7 dB | 22.8 dB |

Note that, the broadband dual polarization antenna 20 shown in FIGS. 3A and 3B is an embodiment of the present invention. Those skilled in the art should make modifications or alterations accordingly. For example, the distance between the first plane PL1 and the second plane PL2, and the distance between the first metal reflective plane 200 and the second radiation portion 204 are not limited to 1 mm and 24.7 mm, and can be other values.

Figure 5A:
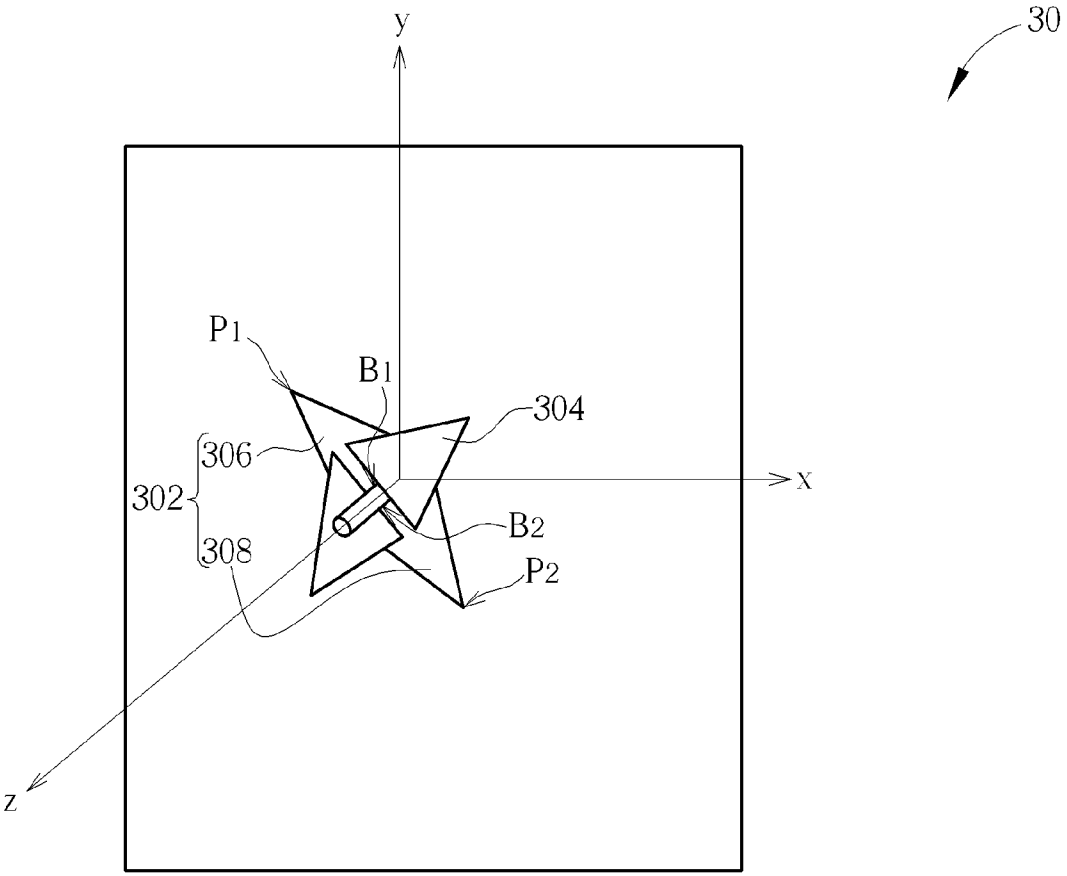
FIG. 5A is a schematic diagram of a broadband dual polarization antenna according an embodiment of the present invention.
Figure 5B:
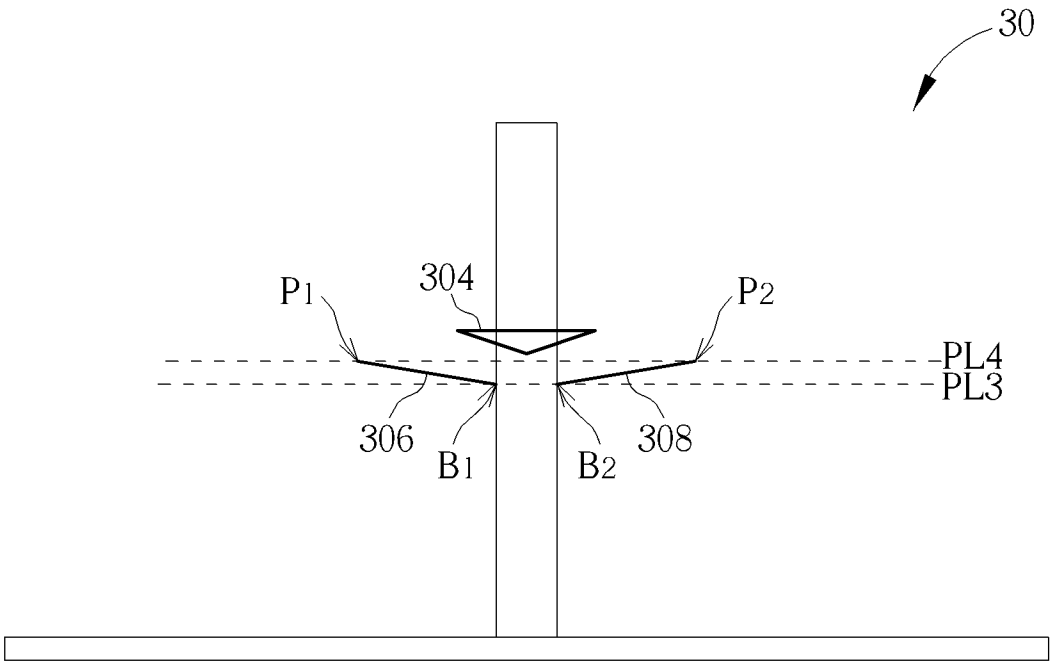
FIG. 5B is a side-view diagram of the broadband dual polarization antenna shown in FIG. 5A.

The broadband dual polarization antenna 20 shown in FIGS. 3A and 3B can be seen as a derivative alteration of the broadband dual polarization antenna 10 shown in FIGS. 1A and 1B, and the main difference between the broadband dual polarization antenna 10 and the broadband dual polarization antenna 20 is that the second radiation portion 204 is leaned down from the supporting element 214 to outside. Similarly, those skilled in the art should readily adjust relationship (such as parallel or not), tilt angle and rotating angle of components of the broadband dual polarization antennas 10 and 20, and not limited thereto. For example, please refer to FIGS. 5A and 5B. FIG. 5A is a schematic diagram of a broadband dual polarization antenna 30 according an embodiment of the present invention. FIG. 5B is a side-view diagram of the broadband dual polarization antenna 30. Structures and compositions of the broadband dual polarization antenna 30 and the broadband dual polarization antenna 20 are similar. For simplicity, most of symbols are omitted, only components for description are marked, and the rest can be referred to FIGS. 3A and 3B. As can be seen by comparing FIG. 3B and FIG. 5B, the difference between the broadband dual polarization antennas 30 and 20 is that a first radiation portion 302 is leaned up toward to a second radiation portion 304. In detail, the first radiation portion 302 comprises a first triangular metal plate 306 and a second triangular metal plate 308. In the embodiment of the present invention, those triangular metal plates conform to isosceles triangles, but are not limited thereto. A base B1 of first triangular metal plate 306 and a base B2 of the second triangular metal plate 308 can be seen as disposed in a third plane PL3 or extending on the third plane PL3, and a vertex P1 of an opposite angle corresponding to the base B1 and a vertex P2 of an opposite angle corresponding to the base B2 are disposed in a fourth plane PL4, wherein the third plane PL3 and the fourth plane PL4 are not the same plane, and are separated by a distance, such as 1 mm.

Figure 6A:
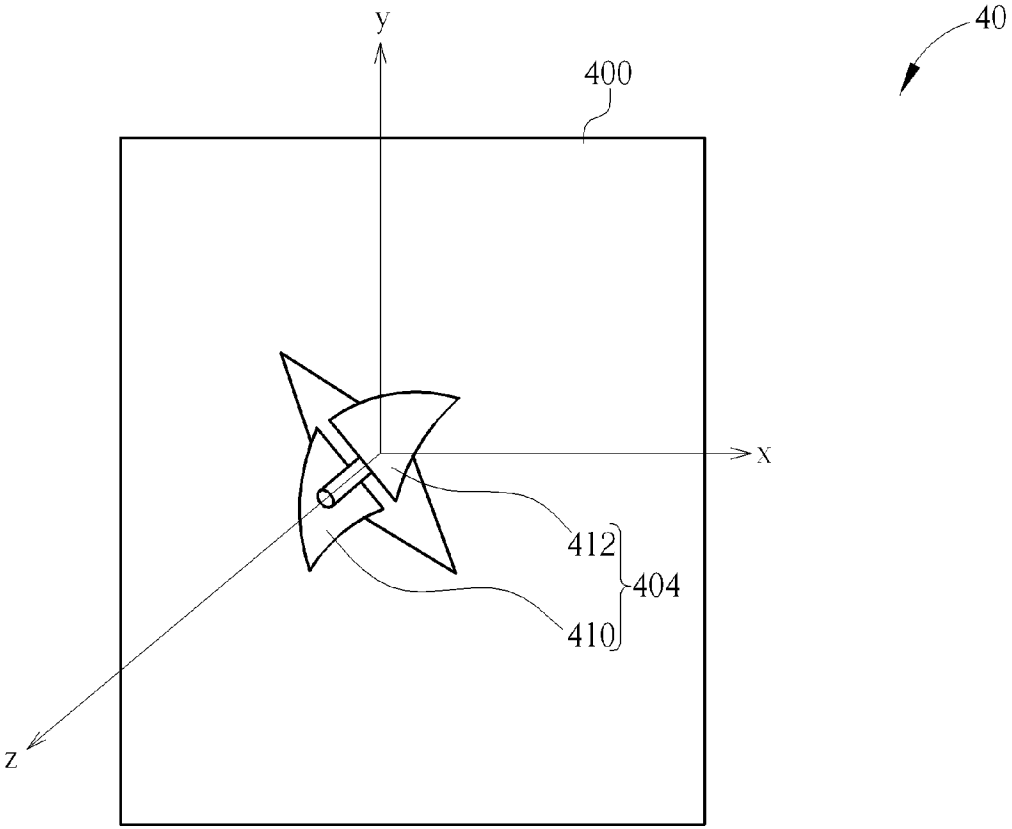
FIG. 6A is a schematic diagram of a broadband dual polarization antenna according an embodiment of the present invention.
Figure 6B:
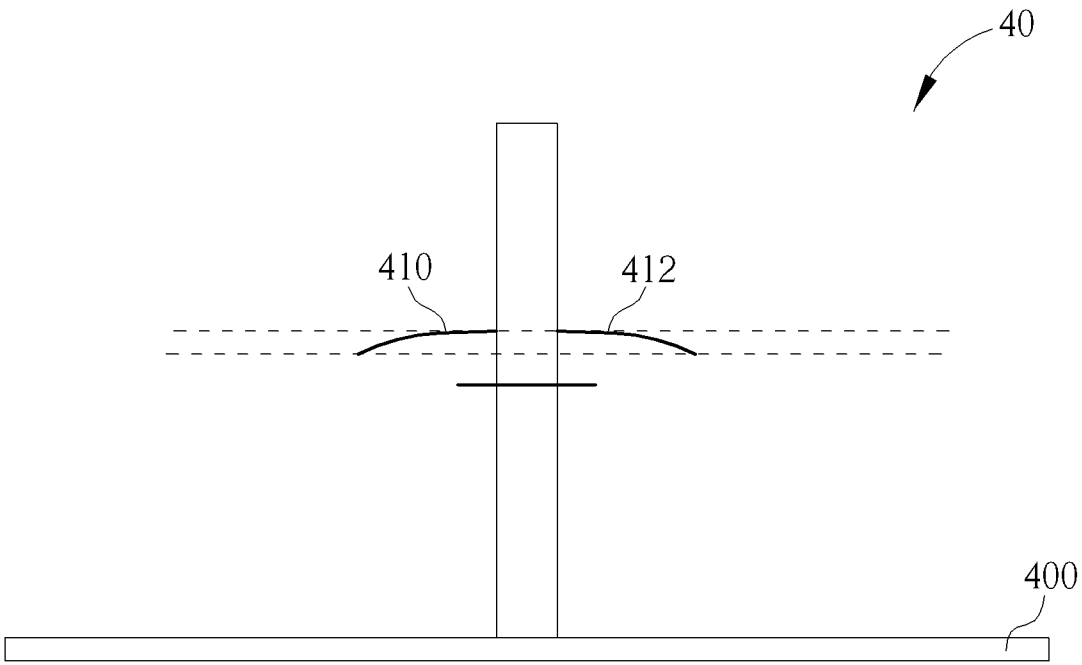
FIG. 6B is a side-view diagram of the broadband dual polarization antenna shown in FIG. 6A.
Figure 7A:
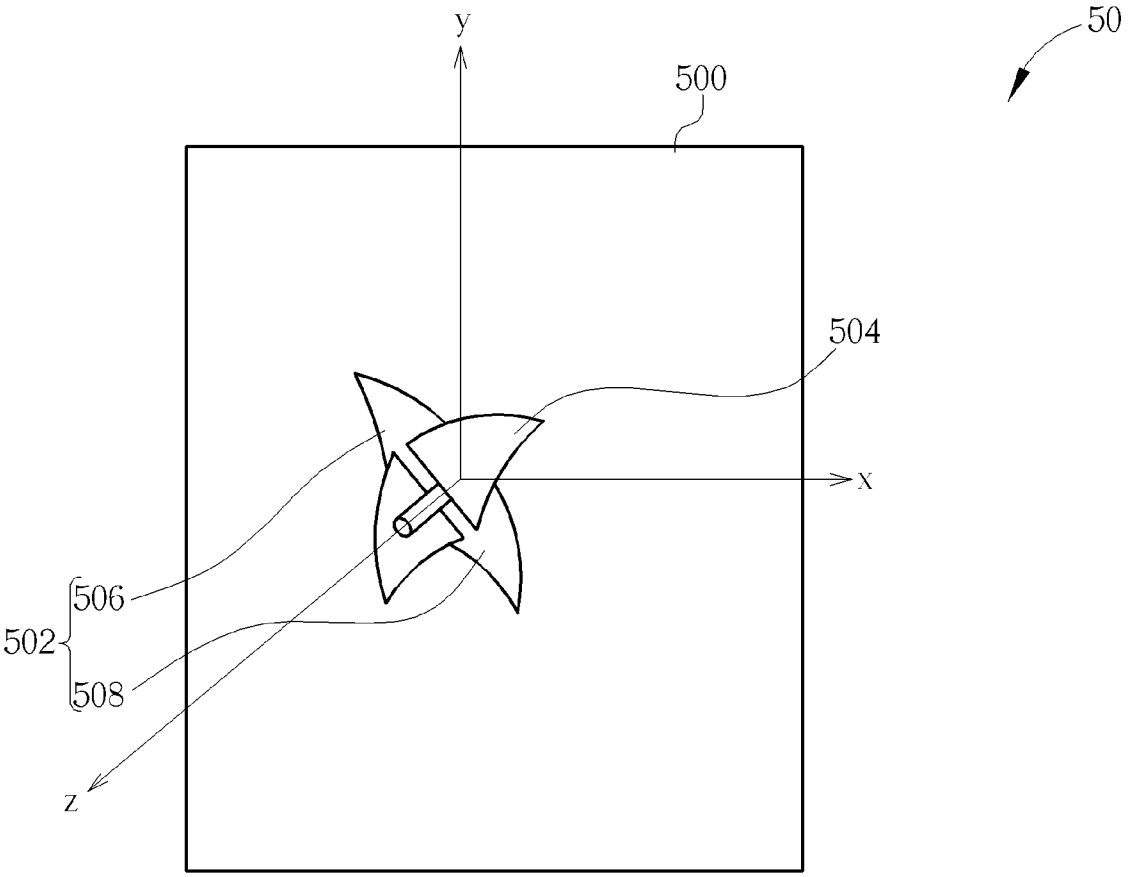
FIG. 7A is a schematic diagram of a broadband dual polarization antenna according an embodiment of the present invention.
Figure 7B:
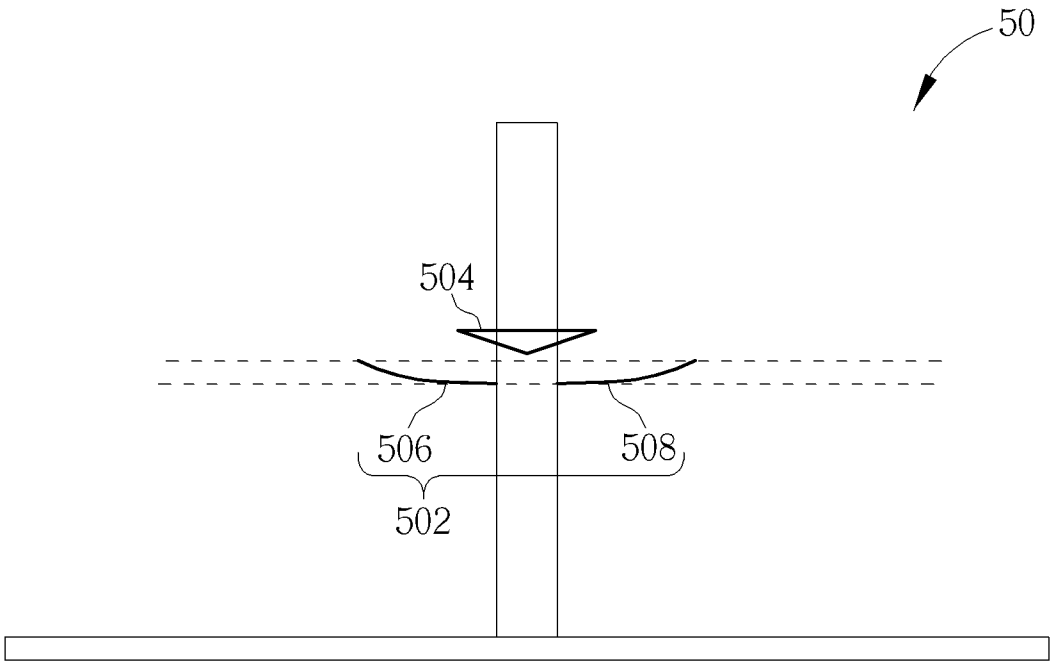
FIG. 7B is a side-view diagram of the broadband dual polarization antenna shown in FIG. 7A.

In the broadband dual polarization antennas 20 and 30, the first to the fourth triangular metal plates are from the supporting element 214 to outside, to adjust distances between those triangular metal plates and the first metal reflective plane. In other words, each of the triangular metal plates is a flat plane. However, the method of adjusting distances between those triangular metal plates and the first metal reflective plane is not limited thereto. For example, please refer to FIGS. 6A and 6B. FIG. 6A is a schematic diagram of a broadband dual polarization antenna 40 according an embodiment of the present invention. FIG. 6B is a side-view diagram of the broadband dual polarization antenna 40. Structures and compositions of the broadband dual polarization antenna 40 and the broadband dual polarization antenna 20 are similar. For simplicity, most of symbols are omitted, only components for description are marked, and the rest can be referred to FIGS. 3A and 3B. As can be seen by comparing FIG. 3B and FIG. 6B, a difference between the broadband dual polarization antenna 40 and the broadband dual polarization antenna 20 is that a second radiation portion 404 of the broadband dual polarization antenna 40 is bended down according to a specific radian. In detail, the second radiation portion 404 comprises a third triangular metal plate 410 and a fourth triangular metal plate 412. In the embodiment of the present invention, those triangular metal plates conform to isosceles triangles, but are not limited thereto. The third triangular metal plate 410 and the fourth triangular metal plate 412 comprise arc portions respectively, and the arc portions are bended toward to a first metal reflective plane 400. As shown in FIG. 6B, the arc portions can also achieve an object of decreasing a distance between the second radiation portion 404 and the first metal reflective plane 400, to increase field patterns of the second radiation portion 404. In addition, please refer to FIGS. 7A and 7B. FIG. 7A is a schematic diagram of a broadband dual polarization antenna 50 according an embodiment of the present invention. FIG. 7B is a side-view diagram of the broadband dual polarization antenna 50. Structures and compositions of the broadband dual polarization antenna 40 and the broadband dual polarization antenna 50 are similar. For simplicity, most of symbols are omitted, only components for description are marked, and the rest can be referred to FIGS. 6A and 6B. As can be seen by comparing FIG. 6B and FIG. 7B, the difference between the broadband dual polarization antenna 40 and the broadband dual polarization antenna 50 is that a first radiation portion 502 of the broadband dual polarization antenna 50 is bended up according to a specific radian. In detail, the first radiation portion 502 comprises a first triangular metal plate 506 and a second triangular metal plate 508. In the embodiment of the present invention, those triangular metal plates conform to isosceles triangles, but are not limited thereto. The first triangular metal plate 506 and the second triangular metal plate 508 comprise arc portions respectively, and the arc portions are bended toward to a second radiation portion 504. As shown in FIG. 7B, the arc portions can also achieve an object of increasing a distance between the first radiation portion 502 and the first metal reflective plane 500, to decrease field patterns of the first radiation portion 502 and balance field patterns.

Figure 8:
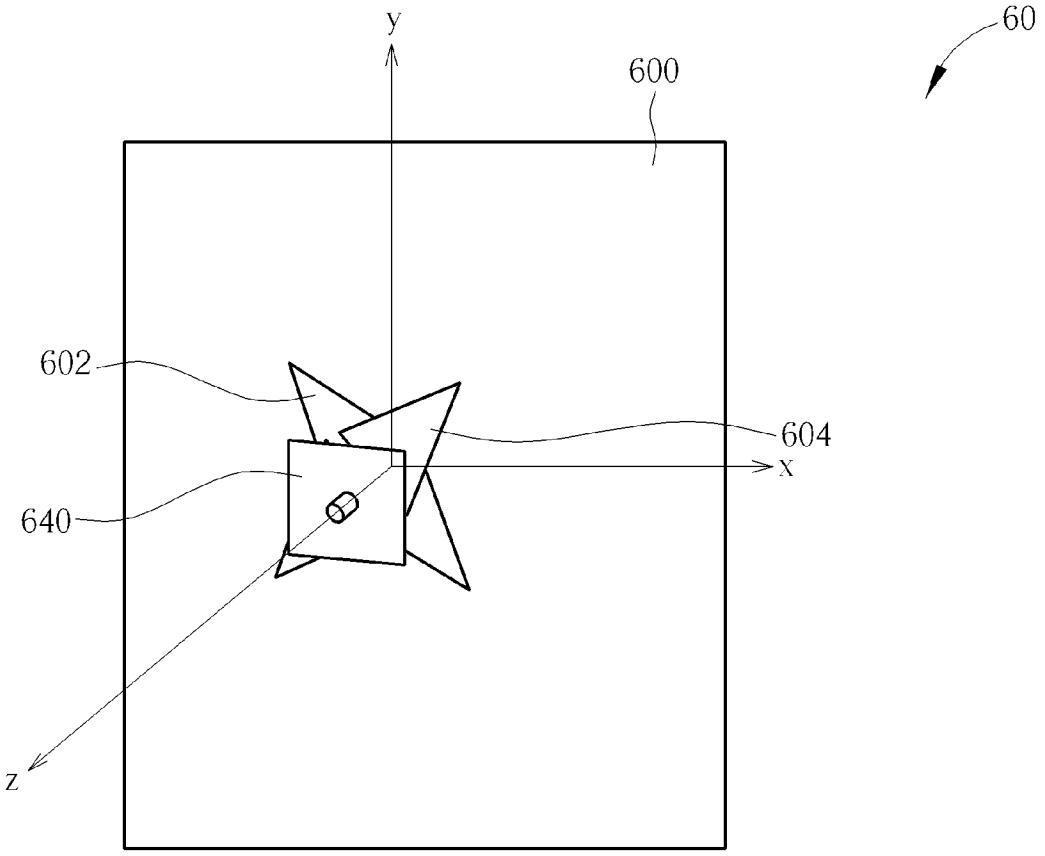
FIG. 8 is a schematic diagram of a broadband dual polarization antenna according an embodiment of the present invention.
Figure 9:
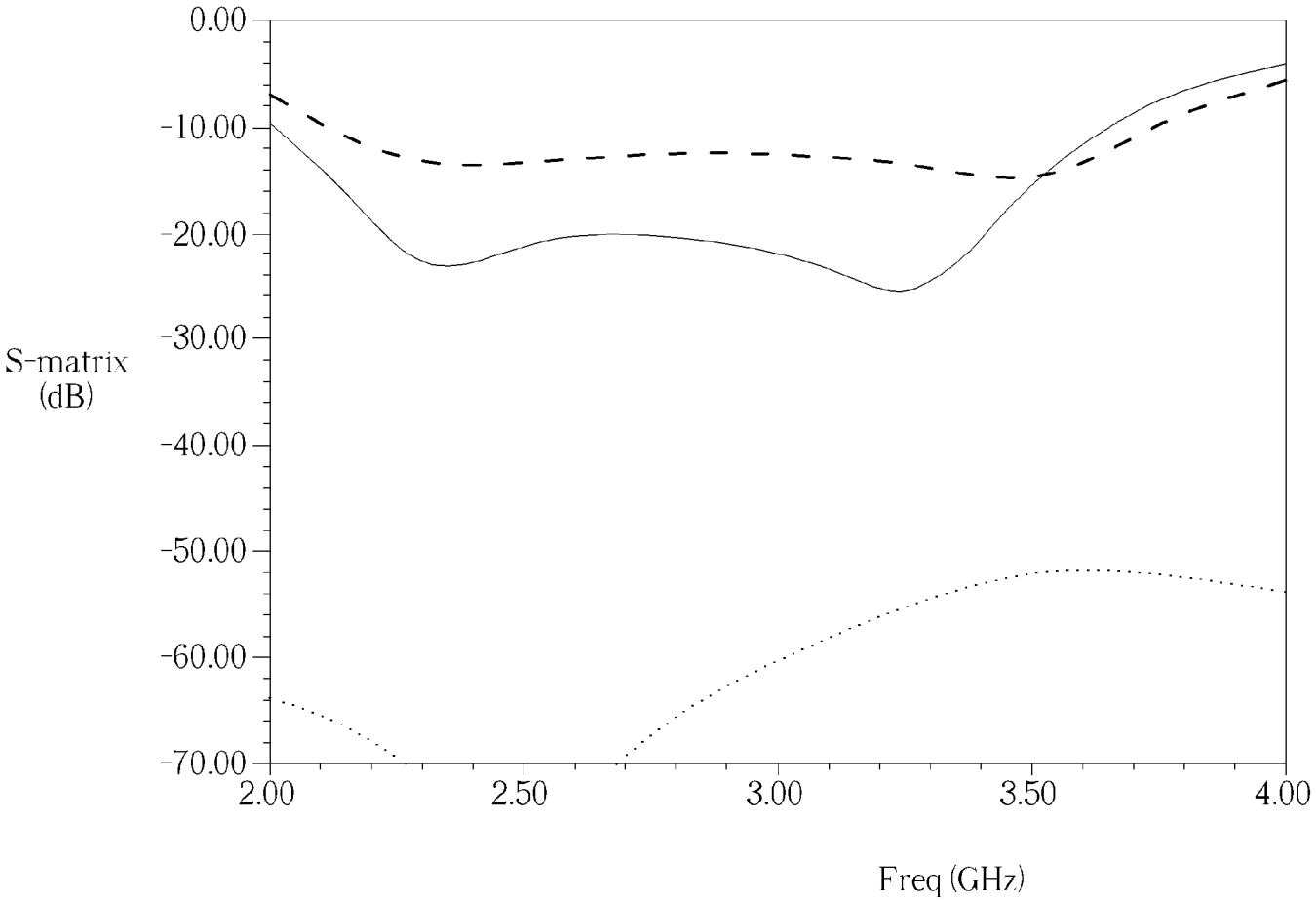
FIG. 9 is simulation results of antenna resonance and isolation of the broadband dual polarization antenna shown in FIG. 8.

Note that, in the embodiments mentioned in the above, the metal reflective planes are utilized for increasing antenna gains, and the number of the metal reflective plane is not limit to 1. For example, please refer to FIG. 8. FIG. 8 is a schematic diagram of a broadband dual polarization antenna 60 according an embodiment of the present invention. Structures and compositions of the broadband dual polarization antenna 60 and the broadband dual polarization antenna 10 are similar. For simplicity, most of symbols are omitted, only components for description are marked, and the rest can be referred to FIG. 1. As can be seen by comparing FIG. 8 and FIG. 1, a difference between the broadband dual polarization antenna 60 and the broadband dual polarization antenna 10 is that the broadband dual polarization antenna 60 further comprises a second metal reflective plane 640. Characteristics of the broadband dual polarization antenna 60 can be obtained by simulation. Please refer to FIG. 9. FIG. 9 illustrates simulation results of antenna resonance and isolation of the broadband dual polarization antenna 60. Simulation conditions of FIG. 9 are shown as follows: the distance between the second metal reflective plane 640 and a first metal reflective plane 600 is equal to 47.7 mm. Besides, a dashed line and a solid line on the top of FIG. 9 are resonance curves of a first radiation portion 602 and a second radiation portion 604 respectively, and a dotted line on the bottom of FIG. 9 is a curve of isolation between the first radiation portion 602 and the second radiation portion 604. As can be seen in FIG. 9, by taking −10 dB as a reference, resonance bandwidth of the broadband dual polarization antenna 60 includes LTE Band38/40/42 simultaneously, and isolation thereof reaches at least −51.8 dB. As can be seen by comparing FIG. 9 and FIG. 2, the broadband dual polarization antenna 60 has wider bandwidth than the broadband dual polarization antenna 10. On the other hand, please refer to Tables 9, 10, 11, and 12. The Tables 9 and 10 are simulation results of field patterns for the first radiation portion 602 on the vertical and horizontal planes respectively, and the Tables 11 and 12 are simulation results of field patterns for the second radiation portion 604 on the vertical and horizontal planes respectively. As can be seen in the Tables 9, 10, 11, and 12, values of the field patterns of the first radiation portion 602 and the second radiation portion 604 are substantially equal to each other in the same frequency band. Therefore, the broadband dual polarization antenna 60 achieves an object of balancing the field patterns. In addition, when the frequency is raised, maximum gains of the broadband dual polarization antenna 60 are increased as well, such that requirements of practical applications can be satisfied (in practical environments, free space loss of wireless signals is increased with frequency).

TABLE 9

| frequency | peak gain | 3 dB beamwidth | front-to-back ratio | Co/Cx |
|---|---|---|---|---|
| 2300 (MHz) | 9.31 dBi | 64 deg | 21.9 dB | 20.3 dB |
| 2400 (MHz) | 9.33 dBi | 64 deg | 23.0 dB | 19.9 dB |
| 2570 (MHz) | 9.26 dBi | 66 deg | 25.3 dB | 19.7 dB |
| 2620 (MHz) | 9.24 dBi | 66 deg | 26.2 dB | 19.7 dB |
| 3400 (MHz) | 11.3 dBi | 54 deg | 24.8 dB | 30.2 dB |
| 3600 (MHz) | 11.8 dBi | 51 deg | 22.4 dB | 25.8 dB |

TABLE 10

| frequency | peak gain | 3 dB beamwidth | front-to-back ratio | Co/Cx |
|---|---|---|---|---|
| 2300 (MHz) | 9.31 dBi | 64 deg | 21.9 dB | 20.3 dB |
| 2400 (MHz) | 9.33 dBi | 64 deg | 23.0 dB | 20.0 dB |
| 2570 (MHz) | 9.26 dBi | 66 deg | 25.3 dB | 19.8 dB |
| 2620 (MHz) | 9.24 dBi | 66 deg | 26.2 dB | 19.8 dB |
| 3400 (MHz) | 11.3 dBi | 54 deg | 24.8 dB | 30.2 dB |
| 3600 (MHz) | 11.8 dBi | 51 deg | 22.4 dB | 25.9 dB |

TABLE 11

| frequency | peak gain | 3 dB beamwidth | front-to-back ratio | Co/Cx |
|---|---|---|---|---|
| 2300 (MHz) | 9.23 dBi | 66 deg | 20.6 dB | 19.9 dB |
| 2400 (MHz) | 9.21 dBi | 66 deg | 21.3 dB | 19.6 dB |
| 2570 (MHz) | 9.07 dBi | 69 deg | 22.9 dB | 19.3 dB |
| 2620 (MHz) | 9.02 dBi | 70 deg | 23.4 dB | 19.4 dB |
| 3400 (MHz) | 10.8 dBi | 58 deg | 23.6 dB | 29.0 dB |
| 3600 (MHz) | 11.3 dBi | 54 deg | 21.0 dB | 26.3 dB |

TABLE 12

| frequency | peak gain | 3 dB beamwidth | front-to-back ratio | Co/Cx |
|---|---|---|---|---|
| 2300 (MHz) | 9.23 dBi | 66 deg | 20.6 dB | 20.0 dB |
| 2400 (MHz) | 9.21 dBi | 66 deg | 21.3 dB | 19.6 dB |
| 2570 (MHz) | 9.07 dBi | 69 deg | 22.9 dB | 19.4 dB |
| 2620 (MHz) | 9.02 dBi | 70 deg | 23.4 dB | 19.4 dB |
| 3400 (MHz) | 10.8 dBi | 59 deg | 23.6 dB | 29.8 dB |
| 3600 (MHz) | 11.3 dBi | 54 deg | 21.0 dB | 26.6 dB |

Figure 10:
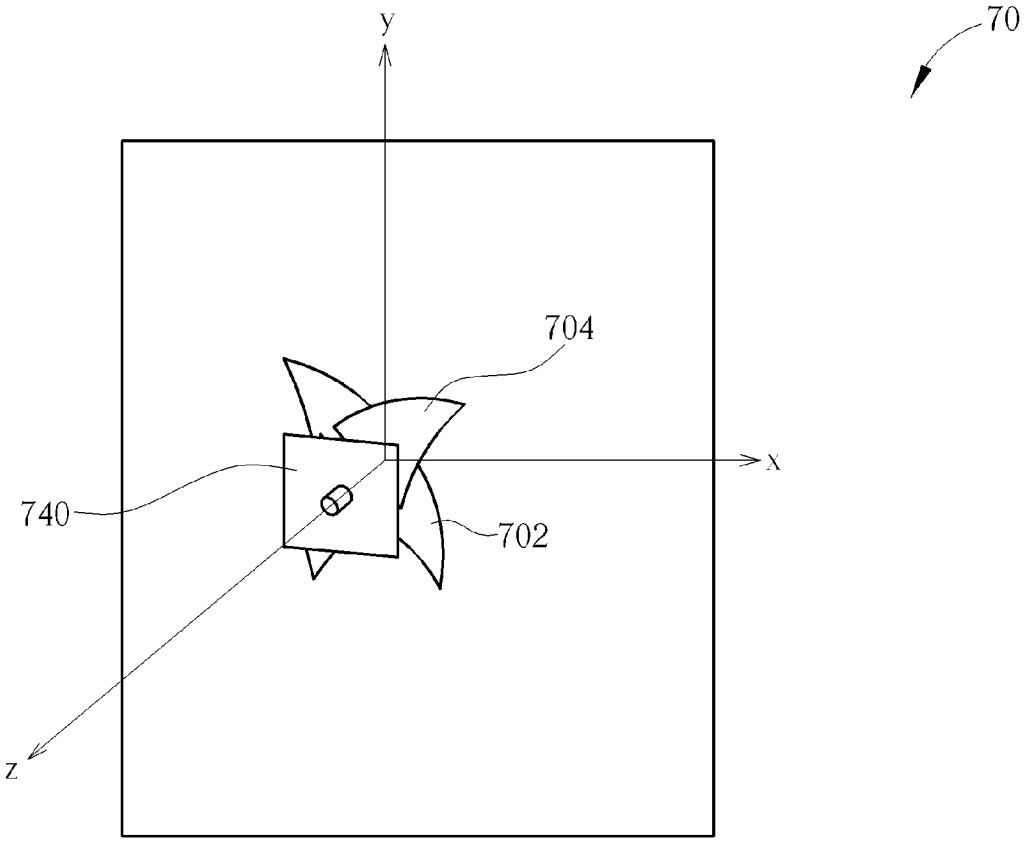
FIG. 10 is a schematic diagram of a broadband dual polarization antenna according an embodiment of the present invention.

Note that, the present invention increases isolation through separating the first radiation portions and the second radiation portions, such that the first radiation portions and the second radiation portions are not electrically connected to each other; balances field patterns through bending the first radiation portions and the second radiation portions; increases gains and bandwidth of the broadband dual polarization antennas through adding the first metal reflective planes and the second metal reflective planes. Those skilled in the art can combine different embodiments according to different antenna requirements. For example, please refer to FIG. 10. FIG. 10 is a schematic diagram of a broadband dual polarization antenna 70 according an embodiment of the present invention. Structures and compositions of the broadband dual polarization antenna 70 and the broadband dual polarization antenna 50 are similar. For simplicity, most of symbols are omitted, only components for description are marked, and the rest can be referred to FIGS. 7A and 7B. The broadband dual polarization antenna 70 is derived by adding a second metal reflective plane 740 to the broadband dual polarization antenna 50, to increase gains of a first radiation portion 702 and a second radiation portion 704.

In the LTE wireless communication system, due to the bands are separated and disordered, conventional dual polarization antennas may not be able to cover all the bands, such that the transceiver can not accurately receive and transmit signals of multiple bands. In contrast, the dual polarization antennas of the present invention satisfy requirements of the LTE wireless communication system for receiving and transmitting signals of multiple bands.

In sum, the present invention combines characteristics of separating the first radiation portions and the second radiation portions, bending the first radiation portions and the second radiation portions, and adding the first metal reflective planes and the second metal reflective planes, to improve antenna field pattern, isolation and operating bandwidth.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A broadband dual polarization antenna, for receiving and transmitting radio signals, the broadband dual polarization antenna comprising:

a first metal reflective plane, for reflecting radio signals, to enhance a gain of the broadband dual polarization antenna;

a first radiation portion, disposed above the first metal reflective plane with a first gap to the first metal reflective plane, the first radiation portion comprising:

a first triangular metal plate; and a second triangular metal plate;

a second radiation portion, disposed above the first radiation portion with a second gap to the first radiation portion, the second radiation portion comprising:

a third triangular metal plate; and a fourth triangular metal plate; and a supporting element, for supporting and isolating the first metal reflective plane, the first radiation portion and the second radiation portion;

wherein a first base of the first triangular metal plate is parallel to a second base of the second triangular metal plate, and a third base of the third triangular metal plate is parallel to a fourth base of the fourth triangular metal plate;

wherein the first radiation portion has a first polarization, and the second radiation portion has a second polarization;

wherein the third base of the third triangular metal plate is in direct physical contact with the supporting element, and the fourth base of the fourth triangular metal plate is in direct physical contact with the supporting element;

wherein the first base of the first triangular metal plate is in direct physical contact with the supporting element, and the second base of the second triangular metal plate is in direct physical contact with the supporting element.

2. The broadband dual polarization antenna of claim 1, wherein an angle is included between a first midline of the first radiation portion and a second midline of the second radiation portion.

3. The broadband dual polarization antenna of claim 2, wherein the angle is substantially equal to 90 degrees.

4. The broadband dual polarization antenna of claim 1, wherein the second gap is greater than or equal to 5 mm.

5. The broadband dual polarization antenna of claim 1, wherein shapes of the first triangular metal plate and the second triangular metal plate are isosceles triangles.

6. The broadband dual polarization antenna of claim 1, wherein the first base of the first triangular metal plate and the second base of the second triangular metal plate are disposed in a first plane, a first vertex of an opposite angle corresponding to the first base of the first triangular metal plate and a second vertex of an opposite angle corresponding to the second base of the second triangular metal plate are disposed in a second plane, and the first plane and the second plane are not the same plane.

7. The broadband dual polarization antenna of claim 1, wherein the first triangular metal plate comprises a first arc bend and the second triangular metal plate comprises a second arc bend.

8. The broadband dual polarization antenna of claim 7, wherein field patterns, isolation, and operating bandwidth of the broadband dual polarization antenna are related to radians of the first arc bend and the second arc bend.

9. The broadband dual polarization antenna of claim 1, wherein the shapes of the third triangular metal plate and the fourth triangular metal plate are isosceles triangles.

10. The broadband dual polarization antenna of claim 1, wherein the third base of the third triangular metal plate and the fourth base of the fourth triangular metal plate are disposed in a third plane, a third vertex of an opposite angle corresponding to the third base of the third triangular metal plate and a fourth vertex of an opposite angle corresponding to the fourth base of the fourth triangular metal plate are disposed in a fourth plane, and the third plane and the fourth plane are not the same plane.

11. The broadband dual polarization antenna of claim 1, wherein the third triangular metal plate comprises a third arc bend and the fourth triangular metal plate comprises a fourth arc bend.

12. The broadband dual polarization antenna of claim 11, wherein field patterns, isolation, and operating bandwidth of the broadband dual polarization antenna are related to radians of the third arc bend and the fourth arc bend.

13. The broadband dual polarization antenna of claim 1, further comprising a second metal reflective plane, disposed on the second radiation portion with a third gap to the second radiation portion, for reflecting radio signals, to enhance the gain of the broadband dual polarization antenna.

14. The broadband dual polarization antenna of claim 13, wherein field patterns, isolation, and operating bandwidth of the broadband dual polarization antenna are related to the first gap, the second gap and the third gap.

* * * * *